United States Patent [19]

Ferrebee

[11] Patent Number: 4,477,077

[45] Date of Patent: Oct. 16, 1984

[54] FOOTBALL PLACE/FIELD GOAL KICKING DEVICE

[76] Inventor: David H. Ferrebee, 122 Eady Ct., Elyria, Ohio 44035

[21] Appl. No.: 478,234

[22] Filed: Mar. 24, 1983

[51] Int. Cl.[3] ..... A63B 67/00

[52] U.S. Cl. ..... 273/55 B

[58] Field of Search ..... 273/55 B

[56] References Cited

U.S. PATENT DOCUMENTS

| | | | |
|---|---|---|---|
| 3,105,686 | 10/1963 | Elsea | 273/55 B |
| 3,439,916 | 4/1969 | Kopp | 273/55 B |
| 3,462,145 | 8/1969 | Shirley et al. | 273/55 B |
| 3,897,948 | 8/1975 | Gerela | 273/55 B |
| 4,049,267 | 9/1977 | Forrest | 273/55 B |

*Primary Examiner*—Richard C. Pinkham
*Assistant Examiner*—T. Brown
*Attorney, Agent, or Firm*—Gustalo Nunez

[57] ABSTRACT

A football place/field goal kicking training device which holds a football in a position for kicking with a holding pressure which simulates being held by a human holder. The training device is used to help a kicker practice field goal kicking and place kicking under conditions simulating actual play. The training device includes a base and a holding device mounted on said base, and three arm elements pivotal about three axes.

3 Claims, 11 Drawing Figures

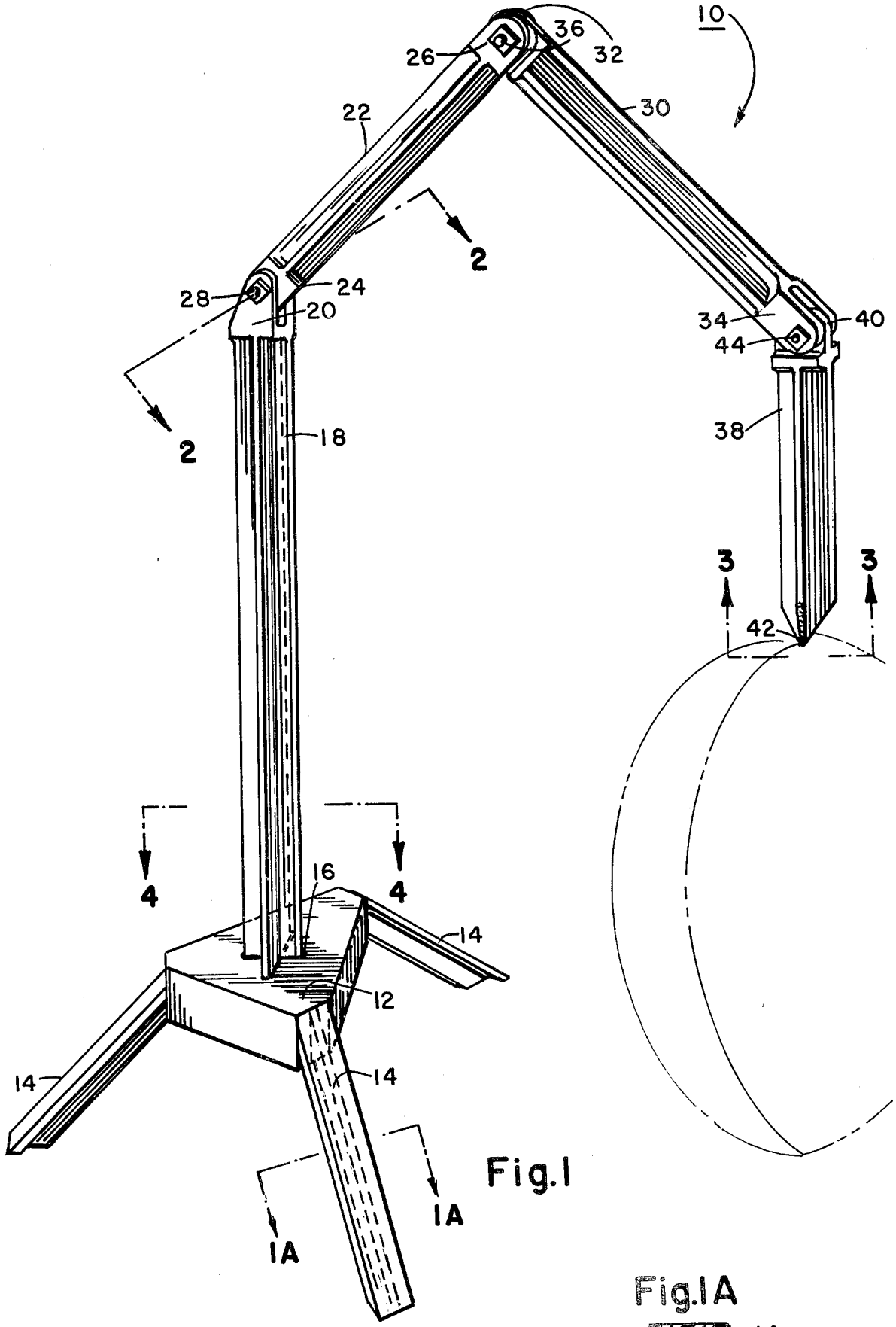
Fig.1
Fig.1A
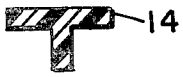

FOOTBALL PLACE/FIELD GOAL KICKING DEVICE

BACKGROUND OF THE INVENTION

The instant invention is directed to a device which is utilized to help a football player practice place kicking and field goal kicking under conditions simulating actual playing conditions. Without a device such as the one contemplated here, it would be necessary to have another person available to hold the ball for the practicing kicker.

It is common knowledge to those who live in the Unites States that many games and championships are won by teams having proficient field goal kickers and place kickers. Many of these have been won with seconds remaining on the game clock thus depriving the other team from having the opportunity to score. In order to be proficient in the art of kicking one must practice, practice and practice. Many times these kicking specialists like to practice their art when no one is around, this is difficult to do without the help of another individual to hold the ball or without the aid of a kicking device, to be disclosed herein. Of course there are some types of practice kicking devices available and they will be discussed shortly.

The instant invention simulates and almost duplicates the actions of a human being holding the football. When the football is kicked, the holding device falls over thus not disturbing or interfering with the trajectory of the football as it leaves the kickers foot. The device herein disclosed can be used on natural playing surfaces or surfaces employing artificial turf.

DESCRIPTION OF THE PRIOR ART

Many and various efforts have been made to develop football kicking devices that work, i.e., simulate actual playing conditions.

One of those efforts representative of such a device is disclosed in U.S. Pat. No. 3,897,948 issued to Gerela. Gerela discloses a football place-kicking device adapted to hold a football in a substantially upright position. Gerela further discloses a rigid shaft member connected to a base and extending upwardly from the base at some angle thereto; and an elongated semi-rigid arm mounted at one end to the shaft member at its upper end and having a free end projecting beyond the edge of the base to engage an upper end surface portion of the football.

Another effort representative of a football kicking device disclosed in U.S. Pat. No. 3,105,686 issued to Elsea. Elsea teached a device which is rather rigid in nature. What we have here is a football holding device with a vertically spaced holding arm for applying downward pressure on a vertically positioned football.

Kopp in U.S. Pat. No. 3,439,916 discloses a football kicking device which includes a pair of opposing members for engaging the sides of a football and holding it above the ground in a position for kicking.

Further, Forrest, U.S. Pat. No. 4,049,267 discloses yet another type of kicking device which is L shaped and like Elsea, above, appears to be of the rigid type.

It can be seen that there has been a great deal of activity in training devices for utilization by football kicking specialists. One reason for this is the great deal of interest football has for the U.S. citizen. Also, it is important to reduce the cost of training kicking specialists which can be done by reducing the number of personnel necessary to help in the training process.

It is submitted that the ideal football holding device would be one that is not mechanically complex, preferably one that could be manufactured by plastic mold injection systems. The training device should be able to hold the football in a substantially vertical position or in an angular position depending on the type of kicking practice desired. The device should be able to simulate the holding pressure of a human holder which must be released instantly upon the kicker making contact with the ball. The instant invention does all of the above and is a device which is surprisingly simple in construction.

None of the prior art teaches a football holding device which utilizes three pivotal elements in a series type of arrangement and which is of a type exceedingly simple in construction and economical to manufacture, and which works very efficiently.

SUMMARY OF THE INVENTION

The football holding training device as contemplated here consists of a base having a support post and an arm attached thereto. The arm consists of three elements, pivotally connected serially to each other. The terminating end, adapted to hold a football is tapered at its end. The training device can hold a football at those angles desired by a place kicker or a field goal kicker, whether he be a traditional kicker or a soccer type kicker. The training device may be used on any type of playing surface and is made of any type of rigid material such as plastic. This device, although made of rigid materials is rather unrigid in practice because of the multi-adjustable pivotal connections holding the arm together. The construction of the pivotal connections are similar to what is known as "tongue and groove" connections.

DESCRIPTION OF THE DRAWINGS

FIG. 1 is a perspective view of the football holding device in accordance with this invention.

FIG. 1A is a cross-sectional view of the football holding device taken along lines 1A—1A of FIG. 1.

DESCRIPTION OF THE PREFERRED EMBODIMENT

Figure 2:
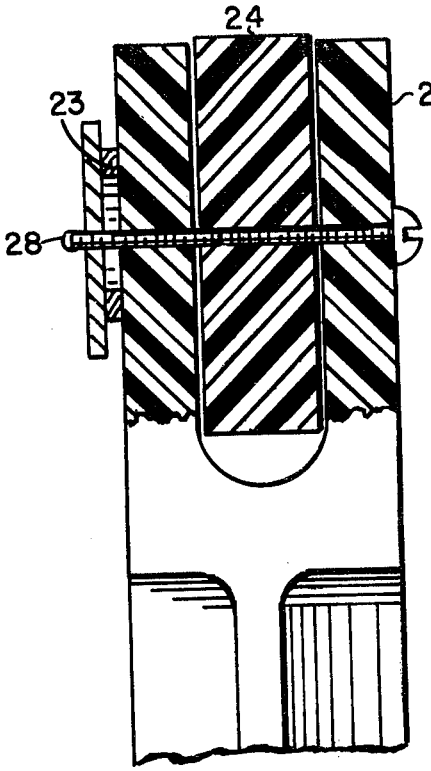
FIG. 2 is a cross-sectional view of the football holding device taken along lines 2—2 of FIG. 1.

Referring now to the drawings and in particular to FIG. 1, there is shown a football kicking device designated by reference numeral 10 and which includes a support base 12 which serves as the only support the kicking device 10 has. In the embodiment shown in FIG. 1, the support base 12 is shown with a plurality of legs 14. The support base 12 is also provided, somewhere center of the support base 12, with an aperature 16, in the embodiment shown, the aperature 16 is shown with an X-like configuration. The support base 10 can be formed of plastic as one integral unit, including the legs 14 and aperature 16, by well known manufacturing methods such as by plastic molded injection. The support base 12 can also be formed without the legs 14. The determination as to whether to have legs or not must be made by the user and as to the locale where the device 10 will be used. Parameters which would dictate such a choice would be the type of surface that the kicking device is to be used on such as short grass, high grass or artificial turf. The support base 12 could easily be provided with means for removeably attaching legs 14 thereto. Projecting upwardly from the base 12 is post 18 which terminates in a slotted configuration 20, see FIGS. 2 and 8. The slotted end 20 is adapted to receive a second arm 22 which at one end terminates in a tongue 24 and at the other end in a slot 26. An opening is provided in the slot 20 and tongue 24 which when alignment with each other is adapted to receive some connecting means 28 such as a spring biased bolt, shown in FIG. 8, which also functions as a pivot point.

Slotted end 26 is adapted to receive an arm 30 which at one end terminates in a tongue 32 and at the other end in a slot 34. Again, an opening is provided in slot 26 and tongue 32 which when in alignment with each other receive some fastening means, again such as a spring biased bolt and again functioning as a pivot point.

Slotted end 34 is adapted to receive a football holding element 38 which at one end terminates in a tongue 40 and terminates at the other end into a tapered end 42. An opening is provided in slotted end 34 and tongue 40 which when in alignment receive a spring biased fastening means 44, which also functions as a pivot point. Post 18 and arm elements 22, 30 and 38, as shown in the preferred embodiment, are X shaped in configuration except for the terminating ends. The fastening means used in the preferred embodiment have been spring biased in nature, however, it is submitted that the fastening means could be replaced by ball and socket connections, thus still providing rotations means for the connection. Also, the arms could be tubular in nature with no loss in flexibility of operation of the football kicking device 10.

Figure 8:
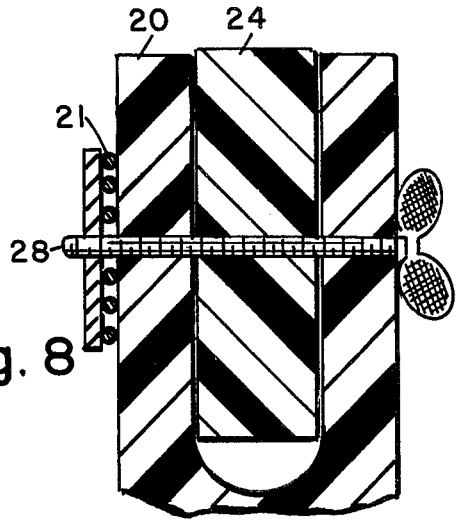
FIG. 8 is an enlarged cross-sectional view of a form of pivot mounting means used on the football holding device.

The biasing spring 21 shown in FIG. 8 can be replaced by some other spring like device such as a lock washer 23 as shown in FIG. 2.

Figure 7:
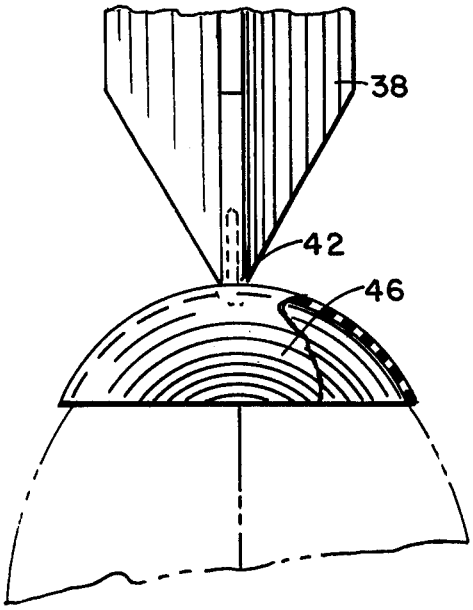
FIG. 7 is an enlarged partial perspective-partial cross-sectional view of a holding cup for the football holding device.

FIG. 7 discloses a spherical cap 46 attached to the football holder end 42. This is utilized when a kicker in training wants to apply more holding power to the football kicking device 10.

The football kicking device 10 as disclosed herein can be used by right and left footed conventional kickers and by right and left footed soccer type kickers with no loss in flexibility of the device 10. Also, the device 10 can be used with different sized footballs, again with no loss in flexibility or efficiency.

The pressure applied to the ball by the device 10 is similar to that applied by a human holder. When the ball is kicked, the device will fall to the side thus not obstructing or interfering with the arc of the kicking foot. As mentioned earlier, this kicking device lends itself well to any surface and can be economically manufactured because of its simple construction. Plastic would be a very desirable material from which to fabricate this kicking device, but it can readily be seen that it can just as easily be made from other materials. Also, the spring biased pivotal elements 22, 30 and football holder 38 renders the operation and use of the kicking device into a very simple operation.

Figure 10:
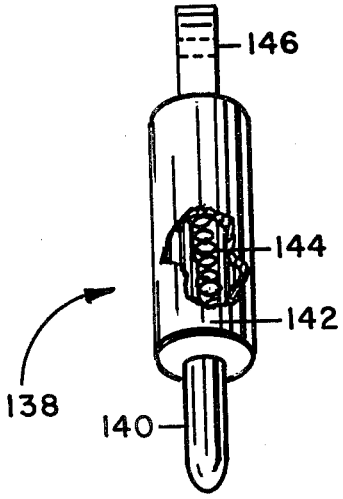
FIG. 10 is a perspective and partial cross-sectional view of an element of the football holding device which performs the holding of the football.
Figure 3:
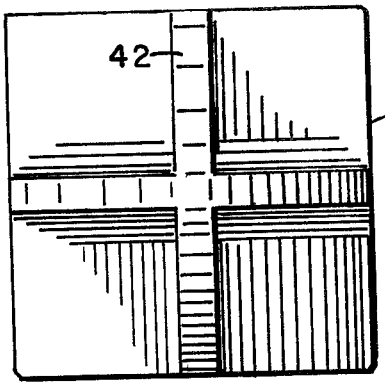
FIG. 3 is a cross-sectional view of the football holding device taken along lines 3—3 of FIG. 1.
Figure 4:
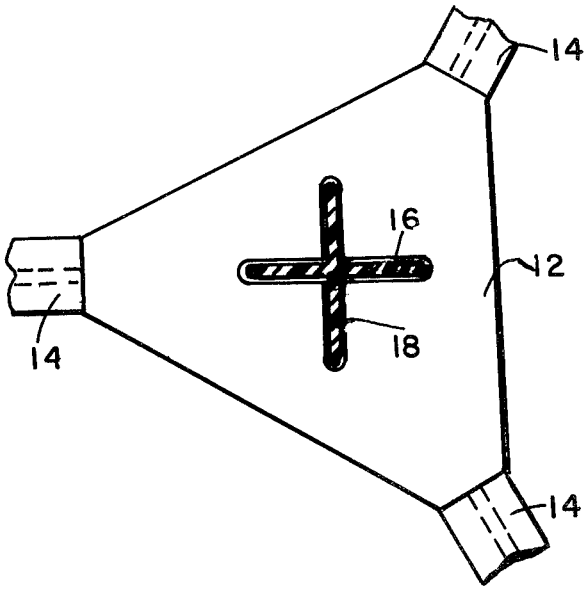
FIG. 4 is a cross-sectional view of the football holding device taken along lines 4—4 of FIG. 1.
Figure 5:
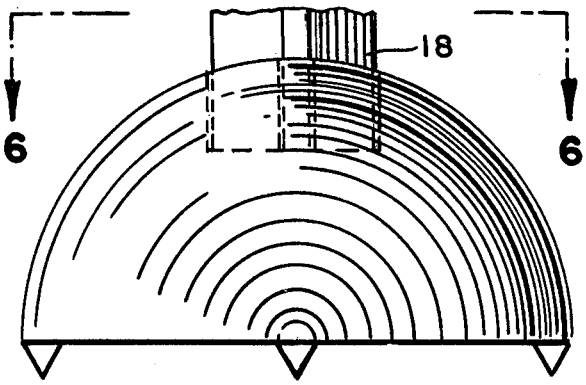
FIG. 5 is a perspective view of the football holding device having a hemispherical base.
Figure 6:
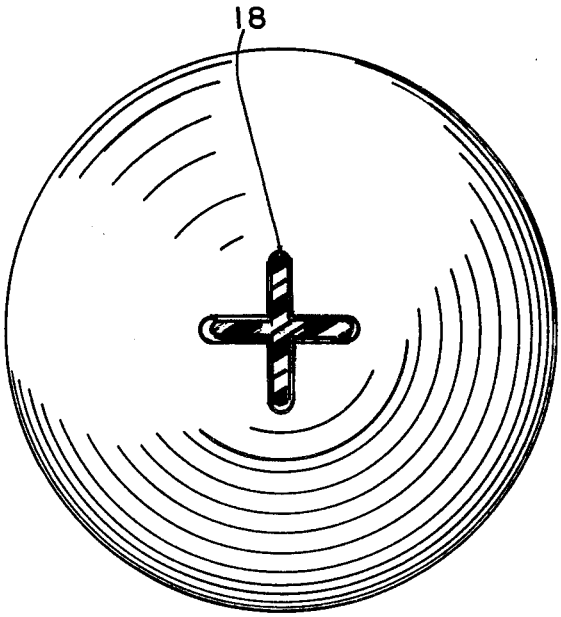
FIG. 6 is a top view of the football holding device taken along lines 6—6 of FIG. 5.

Referring to FIG. 10, there is shown another embodiment of the element which actually holds the football and is designated by reference number 138. The construction of element 138 is in the form of two telescoping hollow tubes 140 and 142. Located within the hollow tubes is a spring biasing force 144 which force is used to apply the actual holding pressure on the football.

All one does is to telescope the tube 140 upward, place the football in position and release the tube 140 which then applies pressure on the football because of the internal spring biasing means 144. The football holding arm 138 functions somewhat differently from the football holding arm 38 shown in FIG. 1 in that the arm 38 is pressured against the football by the movement and adjustment of all the pivotal elements of the entire holding device 10.

Again element 138 like element 38, terminates at one end in a slotted configuration 146 and tapers at the other end. End 146 is designed with an opening such that when the opening is aligned with the opening of slotted end 34, fastening means may be applied therethrough thereby also forming a pivot point.

Figure 9:
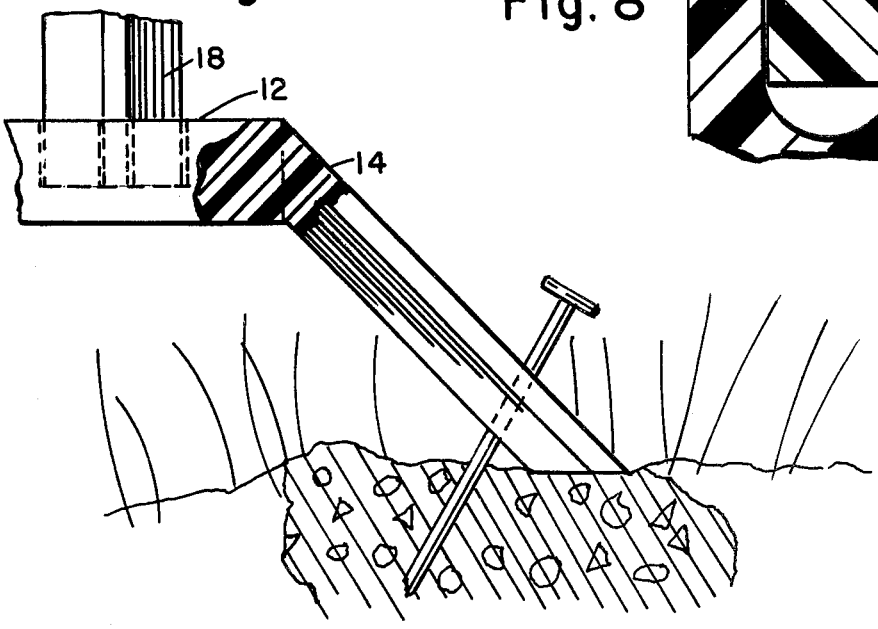
FIG. 9 is an elevational view of means for fastening the football holding device to the playing surface.

Means may also be provided for affixing the football kicking device to the playing surface, if so desired, such as those fastening means shown in FIG. 9.

Changes may be made in the above described kicking device without departing from the scope of invention herein, it is intended that all matter contained in the above description and shown in the accompanying drawings shall be interpreted as illustrative and not in a limiting sense.

What is claimed is:

1. A football kick training device comprising:

(a) a support base including an aperture centrally located thereon, said aperture having an X-like configuration;

(b) an elongated support post constructed in an X-like configuration in transverse cross section, and terminating at one end in a groove type configuration and having a circular aperture on said groove ending;

(c) a first and a second arm element, each arm element constructed in an X-like configuration in transverse cross section and terminating at one end in a groove type configuration and at the other end in a tongue like configuration, the tongue configuration of said first arm element being pivotally connected within the groove configuration of said support post, the groove configuration of said first arm element pivotally connected to the tongue configuration of said second arm element, and said arm elements having means at said pivotal connections for adjustably retaining the arm members in a selected one of plural positions; and (d) a football engaging arm element pivotally secured to one end of said pair of arm elements, said football engaging arm element constructed in an X-like configuration in transverse cross section and terminating at one end in a tongue for pivotal connection with the groove configuration of said second arm element and terminating at its other end in the form of a taper for engaging a football.

2. A football kick training device as described in claim 1 wherein said football engaging arm element is of a pair of spring biased telescoping tubes and where one end terminates in said tongue for connection with one end of said second arm elements and at the other end in the form of a taper for engaging a football.

3. A football kick training device comprising:

(a) a support base including an aperture centrally located thereon, said aperture being X-like in construction, said support base further including a plurality of supporting legs;

(b) an elongated support post constructed in an X-like configuration in transverse cross section, and terminating at one end in a groove type configuration and having a circular aperture on said groove ending;

(c) a first and a second arm element, each arm element constructed in an X-like configuration in transverse cross section and terminating at one end in a groove type configuration and at the other end in a tongue like configuration, the tongue configuration of said first arm element being pivotally connected within the groove configuration of said support post, the groove configuration of said first arm element pivotally connected to the tongue configuration of said second arm element, and said arm elements having means at said pivotal connections for adjustably retaining the arm members in a selected one of plural positions; and (d) a football engaging arm element pivotally secured to one end of said second arm element, said football engaging arm element being a pair of spring biased telescoping tubes and where one end of one tube terminates in a tongue like configuration for connection with said pair of arm element and one end of said other tube terminates in a taper for engaging a football with a biasing means provided a spring internal to said telescoping tubes.

* * * * *